US006493524B2

(12) United States Patent
Kamiya

(10) Patent No.: US 6,493,524 B2
(45) Date of Patent: Dec. 10, 2002

(54) IMAGE FORMING APPARATUS

(75) Inventor: Yuji Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/804,264

(22) Filed: Mar. 13, 2001

(65) Prior Publication Data

US 2001/0036369 A1 Nov. 1, 2001

(30) Foreign Application Priority Data

Mar. 15, 2000 (JP) ..... 2000-077843

(51) Int. Cl.[7] ..... G03G 15/00; G03G 115/02
(52) U.S. Cl. ..... 399/48; 399/38
(58) Field of Search ..... 399/38, 51, 52, 399/48, 50

(56) References Cited

U.S. PATENT DOCUMENTS 4,531,827 A * 7/1985 Tarumi et al. ..... 399/38
4,697,910 A * 10/1987 Kasuya ..... 399/51
5,481,337 A 1/1996 Tsuchiya et al.
5,978,615 A * 11/1999 Tanaka et al. ..... 399/51

FOREIGN PATENT DOCUMENTS

JP 5-313453 * 11/1993

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image bearing member, an image forming unit for forming an image on the image bearing member and a detector for detecting the surface potential of the image bearing member, wherein a first image forming mode and a second image forming mode in which the image forming conditions of the image forming unit are different from each other can be selected, and further, the apparatus includes a controller for controlling the image forming conditions in the first and second image forming modes on the basis of the result detected by the detector for the first image forming mode.

23 Claims, 15 Drawing Sheets

FIG. 8

| | CONVENTIONAL | 1st EMBODIMENT |
|---|---|---|
| ADJUSTMENT OF APPLIED VOLTAGE OF PRIMARY ELECTRIFIER FOR CHARACTER MODE | EXECUTED FOR 2—3 SEC | EXECUTED FOR 2—3 SEC |
| ADJUSTMENT OF APPLIED VOLTAGE OF ORIGINAL LIGHTING LAMP FOR CHARACTER MODE | EXECUTED FOR 2—3 SEC | EXECUTED FOR 2—3 SEC |
| ADJUSTMENT OF APPLIED VOLTAGE OF PRIMARY ELECTRIFIER FOR PHOTOGRAPH MODE | EXECUTED FOR 2—3 SEC | UNNECESSARY : ABOUT 0 SEC |
| ADJUSTMENT OF APPLIED VOLTAGE OF ORIGINAL LIGHTING LAMP FOR PHOTOGRAPH MODE | EXECUTED FOR 2—3 SEC | UNNECESSARY : ABOUT 0 SEC |
| TOTAL TIME FOR POTENTIAL CONTROL | NEEDED FOR ABOUT 8—12 SEC | NEEDED FOR ABOUT 4—6 SEC |

FIG. 15A

| POTENTIAL CONTROL AT POWER-ON | CONVENTIONAL | 1st EMBODIMENT | 2nd EMBODIMENT |
|---|---|---|---|
| ADJUSTMENT OF CHARGE AMOUNT OF PRIMARY ELECTRIFIER FOR PRINTER MODE | EXECUTED FOR 2—3 SEC | EXECUTED FOR 2—3 SEC | EXECUTED FOR 2—3 SEC |
| ADJUSTMENT OF EXPOSURE AMOUNT OF SEMICONDUCTOR LASER FOR PRINTER MODE | EXECUTED FOR 2—3 SEC | EXECUTED FOR 2—3 SEC | EXECUTED FOR 2—3 SEC |
| ADJUSTMENT OF CHARGE AMOUNT OF PRIMARY ELECTRIFIER FOR COPY MODE | EXECUTED FOR 2—3 SEC | UNNECESSARY: ABOUT 0 SEC | EXECUTED FOR 2—3 SEC |
| ADJUSTMENT OF EXPOSURE AMOUNT OF SEMICONDUCTOR LASER FOR COPY MODE | EXECUTED FOR 2—3 SEC | UNNECESSARY: ABOUT 0 SEC | EXECUTED FOR 2—3 SEC |
| TOTAL TIME FOR POTENTIAL CONTROL | NEEDED FOR ABOUT 8—12 SEC | NEEDED FOR ABOUT 4—6 SEC | NEEDED FOR ABOUT 8—12 SEC |
| UNEVEN EFFECTIVE VALUE OF POTENTIAL FOR COPY MODE | ±3V | ±5V | ±3V |
| UNEVEN EFFECTIVE VALUE FOR EACH APPARATUS | NOTHING | ±5V | NOTHING |

FIG. 15B

| POTENTIAL CONTROL AFTER PREDETERMINED TIME ELAPSED | CONVENTIONAL | 1st EMBODIMENT | 2nd EMBODIMENT |
|---|---|---|---|
| ADJUSTMENT OF CHARGE AMOUNT OF PRIMARY ELECTRIFIER FOR PRINTER MODE | EXECUTED FOR 2—3 SEC | EXECUTED FOR 2—3 SEC | EXECUTED FOR 2—3 SEC |
| ADJUSTMENT OF EXPOSURE AMOUNT OF SEMICONDUCTOR LASER FOR PRINTER MODE | EXECUTED FOR 2—3 SEC | EXECUTED FOR 2—3 SEC | EXECUTED FOR 2—3 SEC |
| ADJUSTMENT OF CHARGE AMOUNT OF PRIMARY ELECTRIFIER FOR COPY MODE | EXECUTED FOR 2—3 SEC | UNNECESSARY: ABOUT 0 SEC | UNNECESSARY: ABOUT 0 SEC |
| ADJUSTMENT OF EXPOSURE AMOUNT OF SEMICONDUCTOR LASER FOR COPY MODE | EXECUTED FOR 2—3 SEC | UNNECESSARY: ABOUT 0 SEC | UNNECESSARY: ABOUT 0 SEC |
| TOTAL TIME FOR POTENTIAL CONTROL | NEEDED FOR ABOUT 8—12 SEC | NEEDED FOR ABOUT 4—6 SEC | NEEDED FOR ABOUT 4—6 SEC |
| UNEVEN EFFECTIVE VALUE OF POTENTIAL FOR COPY MODE | ±3V | ±5V | ±5V |
| UNEVEN EFFECTIVE VALUE FOR EACH APPARATUS | NOTHING | ±5V | NOTHING |

IMAGE FORMING APPARATUS

BACKGROUND OF THE INVENTION

1. Field of the Invention

The present invention relates to an image forming apparatus in which a plurality of image forming modes can be selected, and more particularly to an image forming apparatus in which image forming conditions can be varied depending on the selected image forming mode.

2. Related Background Art

There has been hitherto widely performed a technique in which a dark portion potential and a light portion potential are set to desired potentials by employing potential detecting means called a potential sensor for measuring the dark portion potential and the light portion potential on an electrophotographic photosensitive drum serving as an image bearing member.

Here, in order to represent differences in forming an image such as a character mode or a photographic mode, differences in forming an image such as a copy mode or a printer mode and differences due to a toner reducing mode or kinds of sheets to be supplied as images, there has been known a technique (called an image mode) that at least one of the dark portion potential and the light portion potential includes a plurality of kinds of potentials.

For example, while, in the character mode, a high dark portion potential is required so that a copied image has a secure contrast can be obtained, in a photographic mode, since an importance is more attached to a tone reproduction than to a contrast, a slightly low dark portion potential may be employed. Therefore, there may be employed a control (image mode control) by which two kinds of amount of electrification are selectively applied to electrifying means so that two dark portion potentials can be obtained for the above described demands.

Further, there have been also known a plurality of techniques related to a developing potential applied to developing means as one means for forming an image. There may be a technique including respectively a plurality of kinds of three items of an amount of electrification, an amount of exposure and a developing potential so as to get a desired image.

The adjustment of an image mode by utilizing the above described techniques is performed when an image forming apparatus main body is activated, or after an image is formed on a prescribed number of sheets or a prescribed time elapses to adjust the amount of electrification, the amount of exposure and the developing potential so as to constantly obtain a desired image.

However, in the case where there exist a plurality of kinds of the amount of electrification, the amount of exposure and the developing potential as described above, inconveniently, it necessarily takes much time to adjust the image mode. The adjusting time is equivalent to a waiting time for a user. If the user needs to wait for the output of an image, this will disadvantageously cause a productivity to be deteriorated.

In the case where a relatively much time can be ensured depending on the image forming apparatus, since, for instance, an electrophotographic image forming apparatus is adapted to apply heat to fixing means for the purpose of fixing developing toner to a sheet while the image forming apparatus is activated, the image mode control may be frequently carried out during heating of the fixing means and rise of the temperature of the fixing means. In this case, the waiting time is not specially increased in order to adjust the potential.

However, in the case where the image mode is adjusted after the image is formed on a prescribed number of sheets or a prescribed time elapses, much time has been required to perform the adjustment of the image mode, so that the productivity has been undesirably lowered.

SUMMARY OF THE INVENTION

The present invention was proposed in order to solve the above described problems of the prior art, and accordingly, it is an object of the present invention to provide an image forming apparatus excellent in its reliability in which an image mode can be adjusted without deteriorating a productivity.

BRIEF DESCRIPTION OF THE DRAWINGS

FIG. 8 shows a table for comparing the potential control of the first embodiment with the potential control of the conventional example.

FIGS. 15A and 15B show tables indicating the comparison between the potential control of the second embodiment, that of the first embodiment and that of the conventional example.

DETAILED DESCRIPTION OF THE PREFERRED EMBODIMENTS

Figure 1:
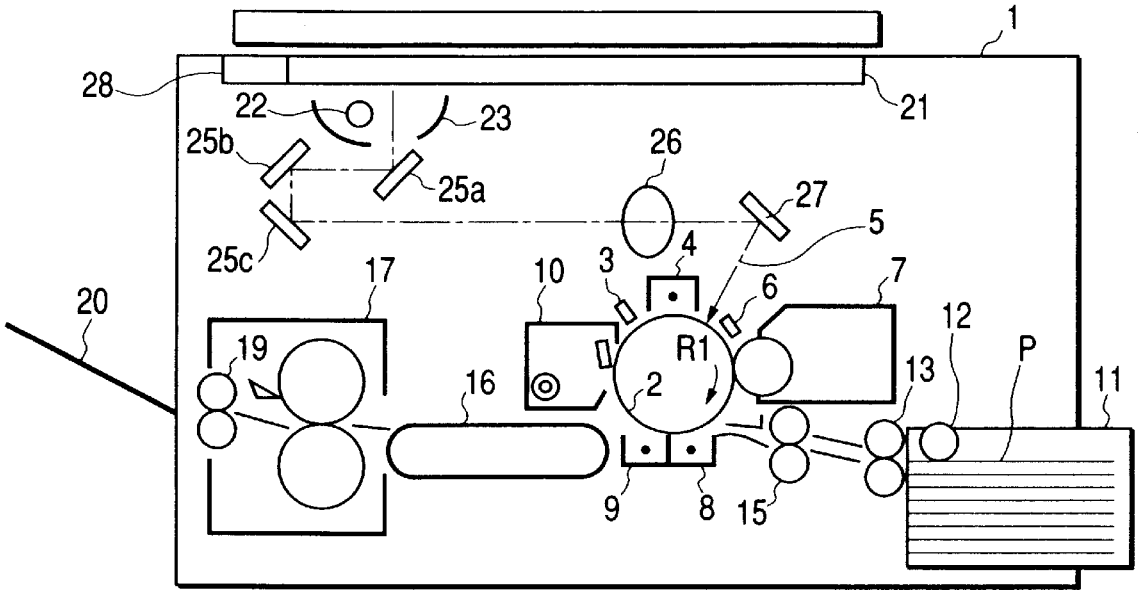
FIG. 1 is a diagram showing a copying machine as one example of an image forming apparatus according to a first embodiment of the present invention.

Now, referring to the drawings, preferred embodiments of the present invention will be illustratively described in detail. In this connection, it is to be understood that the scope of the present invention is not limited only to the size, materials and configurations of components described in the embodiments and the relative arrangements thereof or the like, as long as there is no specific description.

(First Embodiment)

With reference to FIGS. 1 to 5, 6A, 6B, 7A, 7B and 8, a first embodiment of the present invention will be described. FIG. 1 shows a diagrammatic structure of a copying machine as one example of an image forming apparatus according to the first embodiment.

The copying machine is provided with a cylindrical photosensitive drum 2 which is an electrophotographic photosensitive member serving as an image bearing member substantially at the center of an apparatus main body 1.

The photosensitive drum 2 is supported by the apparatus main body 1 so as to be rotatable in the direction shown by an arrow mark R1. On the periphery of the photosensitive drum 2, a deelectrifier 3 for removing a potential on the photosensitive drum 2, a primary electrifier 4 as charging or electrifying means for uniformly electrifying the surface of the photosensitive drum 2, exposure means 5 for exposing the surface of the photosensitive drum 2 to form an electrostatic latent image, a potential sensor 6 as potential detecting means for measuring the potential on the photosensitive drum 2 after an exposure process, a developing device 7 as developing means for allowing toner as a developer to stick to the electrostatic latent image to form a toner image, a transfer electrifier 8 for transferring the toner image to a transfer material P, a separating electrifier 9 for separating the transfer material P from the photosensitive drum 2 and a cleaner 10 for removing residual toner on the photosensitive drum which are sequentially arranged along the rotating direction of the photosensitive drum 2.

The transfer material P to which the toner image is transferred is supplied from a sheet feed deck 11. The sheet feed deck 11 in which the transfer materials P are contained is disposed below the photosensitive drum 2, that is to say, in the lower part inside the apparatus main body 1.

The transfer materials P in the sheet feed deck 11 are supplied by a sheet feed roller 12 and fed to a part between the photosensitive drum 2 and the transfer electrifier 8 through a conveying roller 13 and a registration roller 15. Here, the toner image is transferred to the transfer materials P from the photosensitive drum 2 and the transfer materials P to which the toner image is transferred are conveyed to a fixing device 17 by a conveyor belt 16.

The transfer materials P to which the toner image is fixed by heat and pressure applied by the fixing device 17 are discharged as final copies to a sheet discharge tray 20 by a sheet discharging roller 19.

In the above described copying machine, the exposure means 6 applies light to an original mounted on a platen glass 21 through an original lighting lamp 22 and a reflecting plate 23. The light reflected from an original image is further reflected by mirrors 25*a*, 25*b* and 25*c*, and the reflected light is allowed to pass through an enlargement and reduction lens 26 and guided to the surface of the photosensitive drum 2 through a projection mirror 27.

Thus, the uniformly electrified surface of the photosensitive drum 2 is subjected to an exposure process to form an electrostatic latent image corresponding to the original image on the photosensitive drum 2.

In order to adjust the amount of exposure on the photosensitive drum 2, a standard white plate 28 is disposed in the side of the platen glass 21. The original lighting lamp 22 applies light to the white plate 28 so as to form a light portion potential on the photosensitive drum 2. It is to be noted that while the original lighting lamp is turned off, a primary electrification is carried out so that a dark portion potential can be generated.

Figure 2:
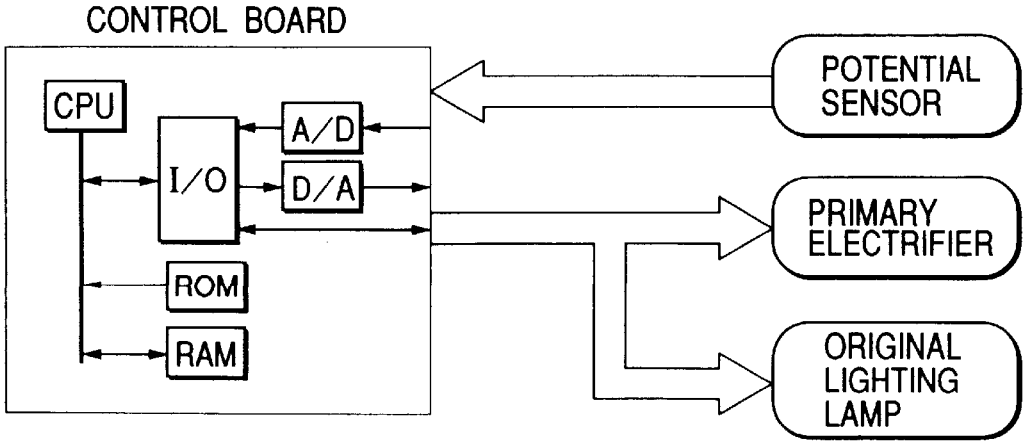
FIG. 2 is a diagram of an electric structure showing the periphery of a control board for measuring the potential of a photosensitive drum according to the first embodiment.

FIG. 2 is a diagram for schematically explaining an electric structure in the periphery of a control board for measuring the potential on the photosensitive drum 2. Referring to FIG. 2, in the control board, a ROM in which a control program is described and a RAM as a temporary storage element for necessary data on a program are connected to a CPU as the central element of processes.

Further, an I/O as an interface element and an A/D converter and a D/A converter as the converting elements of data are connected to external peripheral devices to input information to and output information from the control board. As the peripheral device of the first embodiment, the potential sensor 6 can measure the potential on the photosensitive drum 2 after the photosensitive drum is electrified and exposed.

Then, from the detected result of the potential sensor 6, the applied voltage of the primary electrifier 4 and the applied voltage of the original lighting lamp 22 can be controlled.

Figure 3:
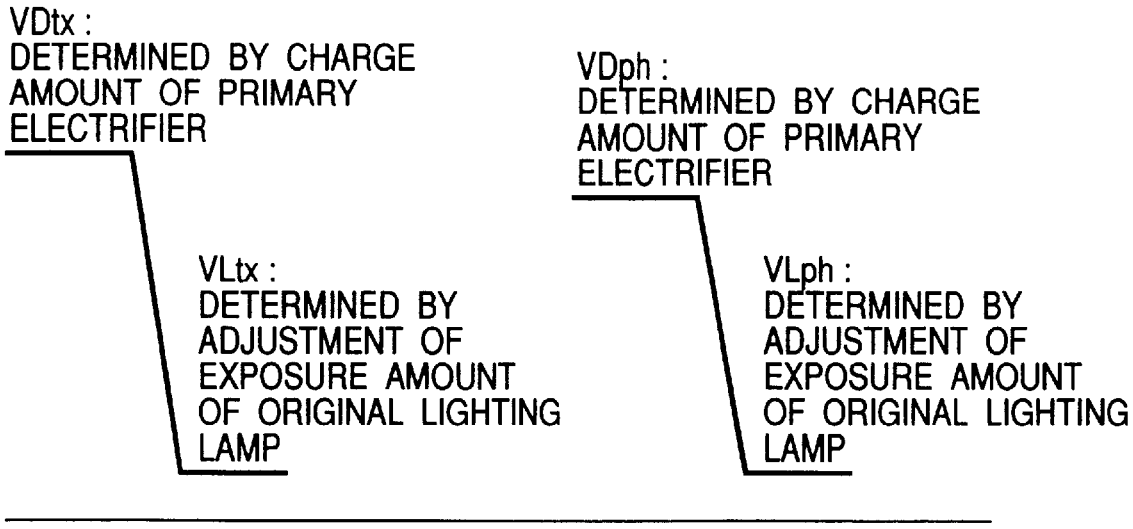
FIG. 3 is a schematic view showing two kinds of potentials (image mode) on a photosensitive drum.

FIG. 3 schematically shows a case in which there exist two kinds of setting potentials on the photosensitive drum 2. The two kinds of setting potentials show two types of image modes including a character mode (with subscript tx) and a photographic mode (with subscript ph). The character mode and the photographic mode can be selected by specifying by an operator on an operation panel or the like.

In this case, the dark portion potentials VDtx and VDph show a case of a black original under a state substantially the same as that obtained when the original lighting lamp 22 is turned off.

The light portion potentials VLtx and VLph show a case of a white original under a state when light is applied to the standard white plate 28.

The character mode supposes an image mainly containing a character original or line drawings so that the high contrast of an image itself is required. Therefore, the dark potential VDtx is set to a relatively high setting target such as 450 V.

In the photographic mode, a tone reproduction is more important than the contrast. Therefore, the dark portion potential VDph is set to 350 V as a setting target lower than the character mode.

In both the image modes, the light portion potentials VLtx and VLph are set to 50 V as a setting target. Since the dark portion potentials are different from each other depending on the image modes, as a matter of course, the amounts of electrification are different. Accordingly, even when the light portion potentials are equal to each other, the necessary amounts of exposure are respectively different.

The potential control (image mode control) for obtaining the setting target of the potential on the photosensitive drum 2 as shown in FIG. 3 is ordinarily performed after the power supply of the image forming apparatus is switched on or activated, after a prescribed time elapses or a prescribed number of sheets are supplied, so that the amount of electrification and the amount of exposure upon output of an image are determined.

Figure 4:
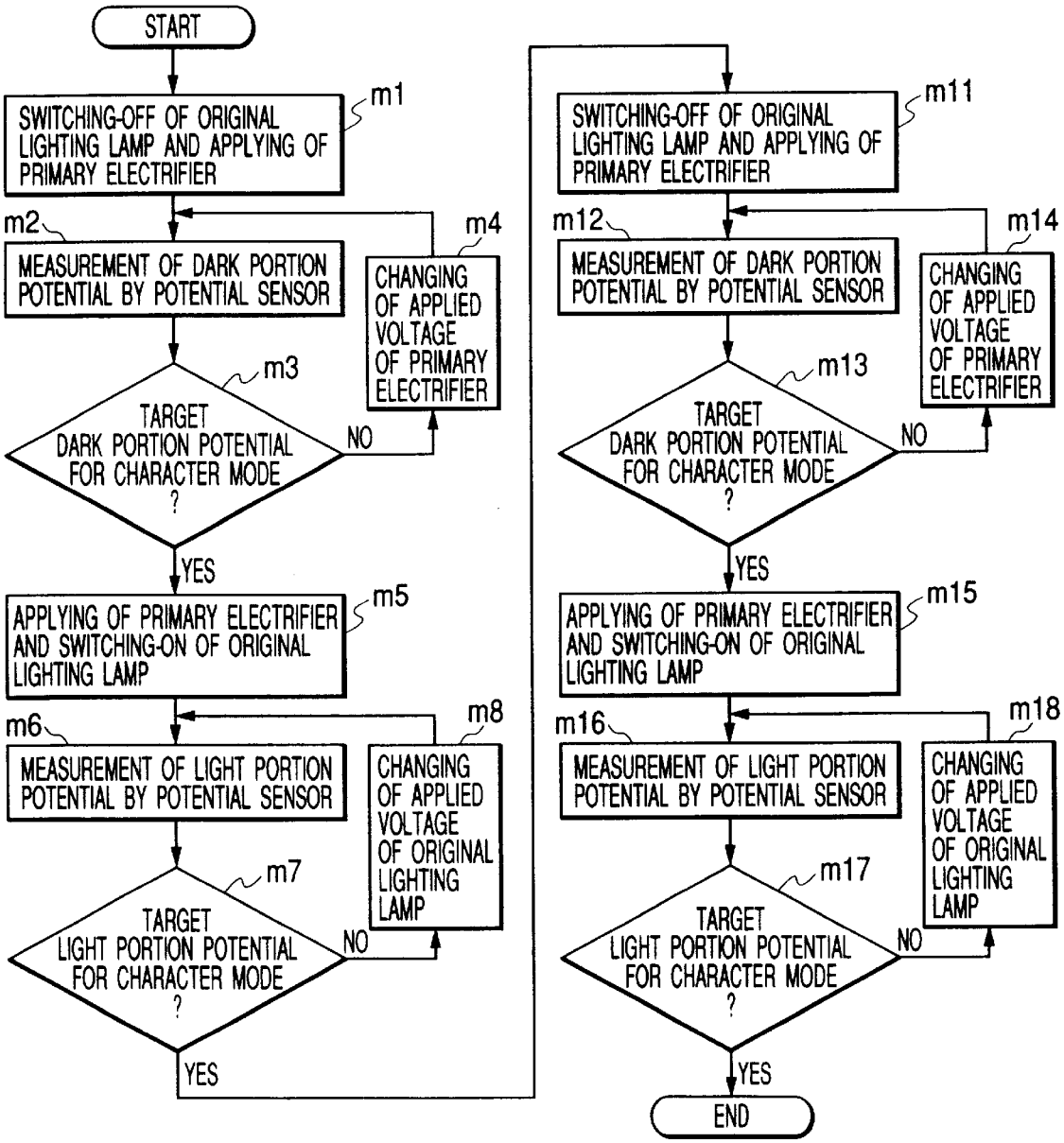
FIG. 4 is a flowchart showing a potential control sequence in a conventional example.

FIG. 4 shows a flowchart of a potential control (image mode control) sequence in a conventional example. Initially, the original lighting lamp 22 is turned off and a prescribed voltage is applied to the primary electrifier 4 to generate an initial dark portion potential VDtx (m1).

The initial applied voltage may be a prescribed value or a voltage value upon control of a previous time. The dark portion potential VDtx is measured by the potential sensor 6 (m2) located in the downstream side of the primary electrifier of the photosensitive drum to recognize (m3) whether or not the dark portion potential reaches 450 V+3 V which is the target dark portion potential VDtx as shown in FIG. 3. When the dark portion potential is not located within a range of 450 V+3 V, the applied voltage of the primary electrifier 4 is increased or decreased (m4) to urge again the dark portion potential VDtx on to reach to the target potential.

Ordinarily, when the voltage value of the previous time is used as the first applied voltage of the primary electrifier 4, a convergence when the sequence is urged on or driven in is improved, however, it has been found by experience that the applied voltage needs to be increased or decreased about two or three times owing to the environmental characteristic or the variation (unevenness) in the circumferential direction of the photosensitive drum 2.

Now, while the photosensitive durum 2 is electrified by the applied voltage of the primary electrifier 4 driven in the above described sequence, the light of the original lighting lamp 22 is applied to the standard white plate 28 to generate the light portion potential VLtx on the photosensitive drum 2 (m5).

At this time, the voltage applied to the original lighting lamp 22 may be also a prescribed value or a voltage value upon control of a previous time. This light portion potential VLtx is measured by the potential sensor 6 (m6) to recognize whether or not the light portion potential reaches 50 V+3 V which is the target light portion potential VLtx as shown in FIG. 3 (m7).

When the light portion potential is not located within a range of 50 V+3 V, the applied voltage of the original lighting lamp 22 is increased or decreased (m8) to urge again the light portion potential VLtx on to reach to the target potential.

It has been also known by experience that the applied voltage ordinarily needs to be increased or decreased two or three times for the light portion potential VLtx.

Subsequently, the amount of electrification and the amount of exposure for the photographic mode need to be adjusted. Initially, the original lighting lamp 22 is turned off and a prescribed voltage is applied to the primary electrifier 4 to generate an initial dark portion potential VDph (m11).

The initial applied voltage may be a prescribed value or a voltage value upon control of a previous time. This dark portion potential VDph is measured by the potential sensor 6 (m12) located in the downstream side of the primary electrifier 4 of the photosensitive drum 2 to recognize (m13) whether or not the dark portion potential reaches 350 V+3 V which is the target dark portion potential VDph as shown in FIG. 3.

If the dark portion potential is not located within a range of 350 V±3 V, the applied voltage of the primary electrifier 4 will be increased or decreased (m14) to urge again the dark portion potential VDph on to reach to the target potential.

Further, while the photosensitive drum 2 is electrified by the applied voltage of the primary electrifier 4 urged on in the above described sequence, the light of the original lighting lamp 22 is applied to the standard white plate 28 to generate the light portion potential VLph on the photosensitive drum 2 (m15). At this time, the voltage applied to the original lighting lamp 22 may be also a prescribed value or a voltage value upon control of the last time.

This light portion potential VLph is measured by the potential sensor 6 (m16) to recognize (m17) whether the light portion potential reaches 50 V±3 V which is the target light portion potential VLph as shown in FIG. 3.

When the light portion potential is not located within a range of 50 V+3 V, the applied voltage of the original lighting lamp 22 is increased or decreased (m18) to urge again the light portion potential VLph on to reach to the target potential.

In order to optimize the dark portion potential VDph and the light portion potential VLph in the photographic mode, the amount of electrification and the amount of exposure thereof respectively need to be adjusted about two or three times.

The photosensitive drum 2 explained in the conventional example, the first embodiment and other embodiments described below is an amorphous silicone drum whose outside diameter is ϕ80 mm. The rotating speed (what is called, process speed) is set to 240 mm/s and the photosensitive drum 2 is designed to rotate once for about one second.

Further, in order to suppress the detection error of the potential sensor 6 due to a circumferential variation in potential of the photosensitive drum 2, eight sampling points for performing sampling processes are circumferentially provided at intervals of about 45° on one circumference of the photosensitive drum 2 to perform the eight sampling processes. Then, the average of the eight sampled results is employed as one data.

As described above, according to the conventional example, since it is necessary to perform detecting operations about five times in order to obtain one kind of dark portion potential VD and one kind of light portion potential VL, a detecting time of about 5 seconds is required. In other words, in order to optimize all potentials in both the image modes including the character mode and the photographic mode, a detecting time of about 10 seconds is required.

The above described potential control (image mode control) is performed when the power of the image forming apparatus 1 is switched on or just before the output of an image after a prescribed time (here, after 10 to 60 minutes when the power is switched on).

Since the heating time for several ten seconds or several minutes is needed for the fixing device 17 in the image forming apparatus upon switching on the power supply, a sufficient time may be provided to perform the potential control. However, the power control after a prescribed time is performed immediately before the output of the image after the lapse of the prescribed time, and accordingly, the outputting operation of the image at this time is inconveniently delayed by about 10 seconds.

Figure 5:
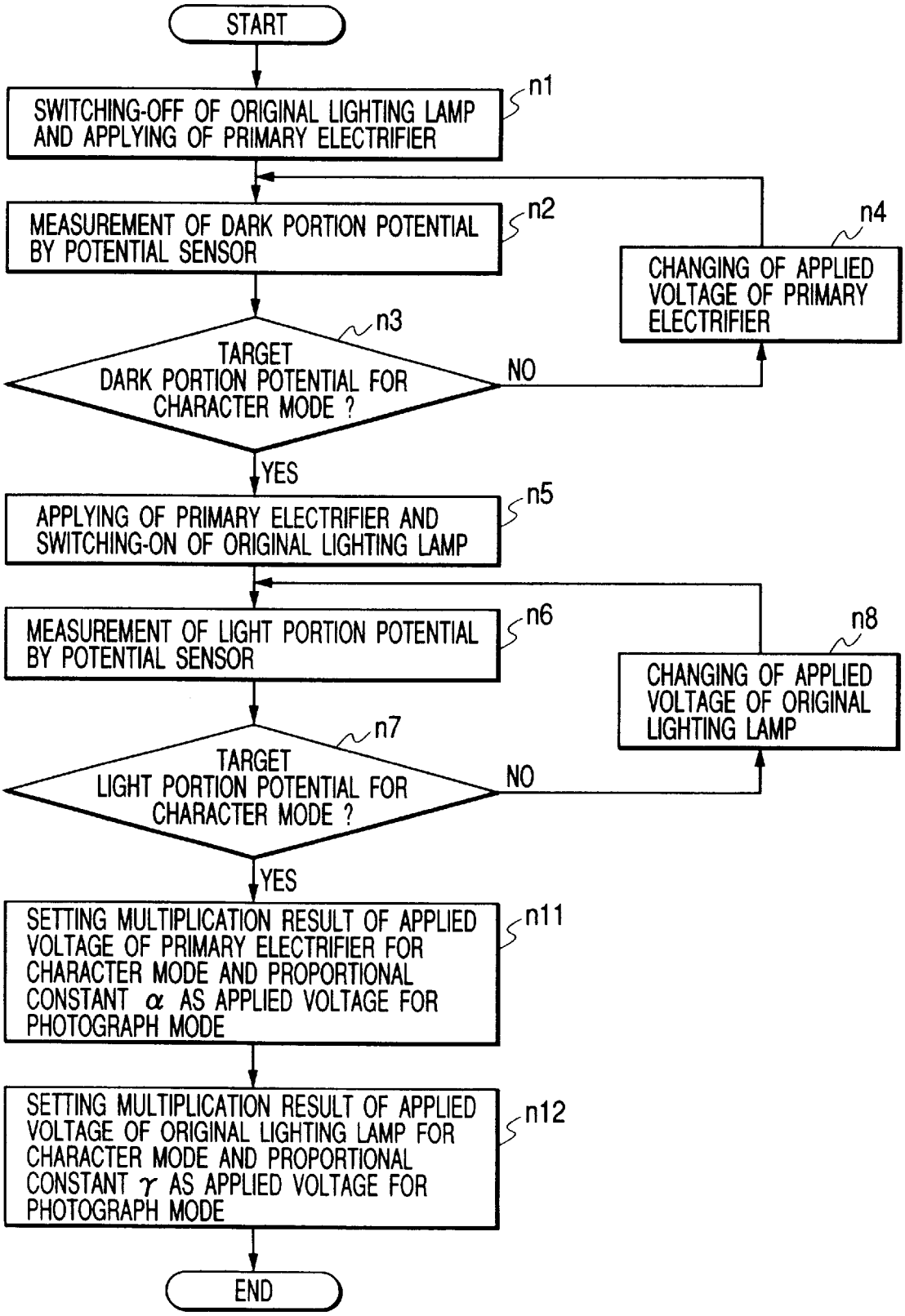
FIG. 5 is a flowchart showing a potential control sequence in the first embodiment.

Thus, in the first embodiment of the present invention, a potential control sequence as shown in FIG. 5 is adopted as image mode control means. In this case, the original lighting lamp 22 is turned off and a prescribed voltage is applied to the primary electrifier 4 to obtain an initial dark portion potential VDtx (n1).

The initial applied voltage may be a prescribed value or a voltage value upon control of the last time. This dark portion potential VDtx is measured by the potential sensor 6 in the downstream side of the primary electrifier 4 of the photosensitive drum 2 (n2) to recognize (n3) whether or not the dark portion potential reaches 450 V±3 V which is the target dark portion potential VDtx as shown in FIG. 3.

When the dark portion potential is not located within a range of 450 V±3 V, the applied voltage of the primary electrifier 4 is increased or decreased (n4) to urge again the dark portion potential VDtx on to reach to the target potential.

Subsequently, while the photosensitive drum 2 is electrified by the applied voltage of the primary electrifier 4 driven in the above described sequence, the light of the original lighting lamp 22 is applied to the standard white plate 28 to generate the light portion potential VLtx on the photosensitive drum 2 (n5). At this time, voltage applied to the original lighting lamp 22 may be also a prescribed value or a voltage value upon control of the last time.

This light portion potential VLtx is measured by the potential sensor 6 (n6) to recognize (n7) whether the light portion potential reaches 50 V±3 V which is the target light portion potential VLtx as shown in FIG. 3.

When the light portion potential is not located within a range of 50 V+3 V, the applied voltage of the original lighting lamp 22 is increased or decreased (n8) to urge again the light portion potential VLtx on to reach to the target potential.

The above described sequence n1 to n8 for the character mode is performed in a similar manner to that of the conventional example.

Subsequently, an amount of electrification and an amount of exposure for the photographic mode need to be determined. In the conventional example, a sequence basically equal to that of the character mode has been employed. On the other hand, in the first embodiment, the amount of electrification and the amount of exposure of the photographic mode are determined without performing a measurement for adjustment, nor adjusting the amount of electrification and the amount of exposure.

Initially, the applied voltage of the primary electrifier 4 adjusted in the character mode is simply multiplied by a prescribed proportional constant a to obtain a product and the product is used as the applied voltage of the primary electrifier 4 in the photographic mode (n11).

Then, the applied voltage of the original lighting lamp 22 adjusted in the character mode is multiplied by a prescribed proportional constant $\gamma$ to obtain a product and the product is used as the applied voltage of the original lighting lamp 22 in the photographic mode (n12).

Only the above described sequence is added to the sequence of the character mode so that a dark portion potential VDph and a light portion potential VLph for photographic mode can be created.

Figure 6A:
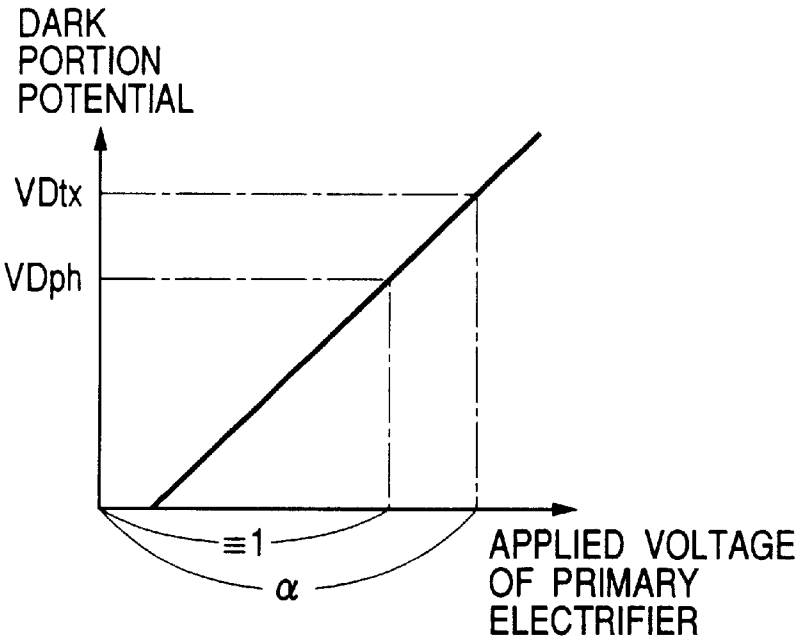
FIGS. 6A and 6B show explanatory views showing a dark portion potential on the photosensitive drum relative to the applied voltage of a primary electrifier.
Figure 6B:
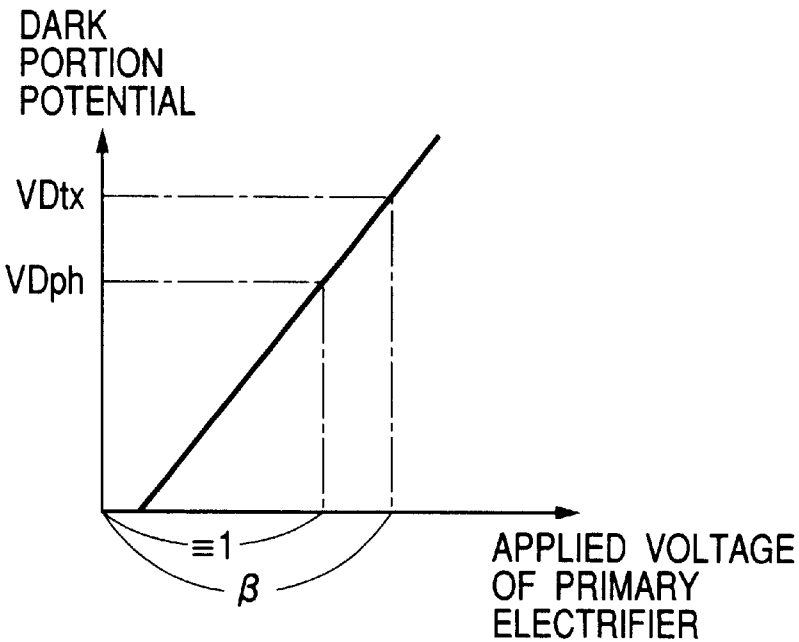

FIGS. 6A and 6B show a relation between a dark portion potential on the photosensitive drum 2 and a voltage applied to the primary electrifier 4. FIG. 6A shows results under a condition that the dark portion potential is not relatively raised depending on the state of the primary electrifier 4 or the state of the photosensitive drum 2 and FIG. 6B shows results under a condition that the dark portion potential is apt to be more raised than that in FIG. 6A.

The state of the primary electrifier 4 may indicate a distance between the electrifying or charging member of the primary electrifier 4 and the photosensitive drum 2, the stain of the electrifying member or the applied bias of a grid not shown in the drawings, etc. The state of the photosensitive drum 2 may indicate the difference of electrification capacity. In FIGS. 6A and 6B, respective discharge start voltages are different from each other and a value of FIG. 6B is smaller than that of FIG. 6A in view of the capability of an image output device.

Consequently, the applied voltages of the primary electrifier 4 required for obtaining two kinds of dark portion potentials VDtx and VDph are naturally different from each other as shown in FIGS. 6A and 6B. Although the ratio of the applied voltages necessary for obtaining VDph from VDtx is expressed by $\alpha$ and $\beta$ respectively shown in FIGS. 6A and 6B, the relation between $\alpha$ and $\beta$ is actually expressed by $\alpha \cong \beta$.

Therefore, after the applied voltage of the primary electrifier 4 required for acquiring VDtx is adjusted, the adjusted applied voltage is simply multified by ($\alpha \cong \beta$) to obtain a value and the obtained value is applied to the primary electrifier 4, so that VDph which is relatively similar to the target dark portion potential can be formed on the photosensitive drum.

Figure 7A:
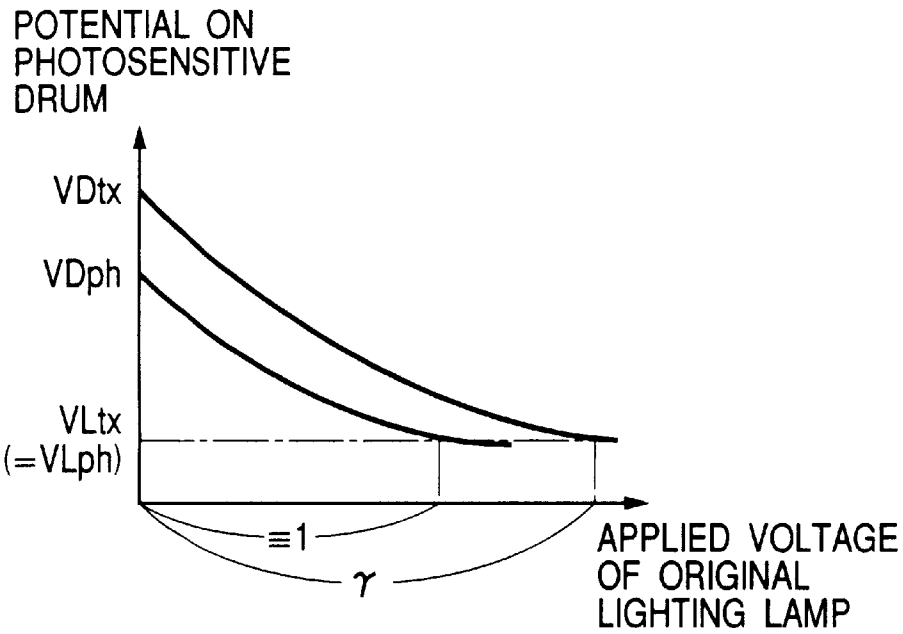
FIGS. 7A and 7B show explanatory views of the potential on the photosensitive drum when the applied voltage of an original lighting lamp is changed while different dark portion potentials are generated on the photosensitive drum.
Figure 7B:
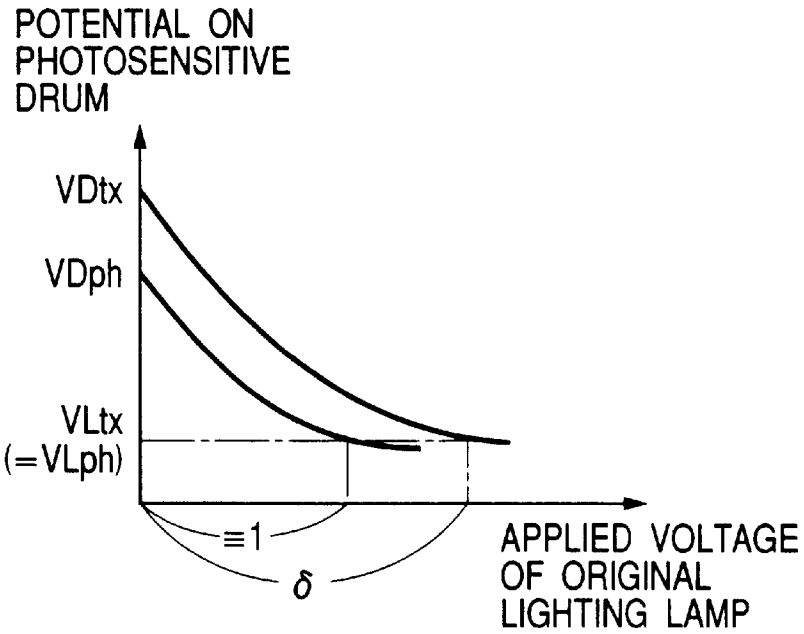

FIGS. 7A and 7B show potentials on the photosensitive drum 2 when the applied voltage of the original lighting lamp 22 is changed under a condition that the dark portion potentials VDtx and VDph are formed on the photosensitive drum 2. FIG. 7A shows results obtained under a condition that a potential is relatively hardly lowered depending on the state of the original lighting lamp 22 and the state of the photosensitive drum 2, and FIG. 7B shows results obtained under a condition that the potential is apt to be lowered more than that of FIG. 7A.

Here, the state of the original lighting lamp 22 may include a difference in efficiency of the original lighting lamp 22, the quantity of light depending on a deteriorated state or a difference in sensitivity from the state of the photosensitive drum 2.

In the case where the ratio of the applied voltages of the original lighting lamp 22 for obtaining the light portion potential is measured, the respective applied voltages of the original lighting lamp 22 shown in FIGS. 7A and 7B are naturally different from each other. The ratio of the applied voltage of the original lighting lamp when the dark portion potential is VDph relative to that when the dark portion potential is VDtx is shown by $\gamma$ and $\delta$ in FIGS. 7A and 7B. However, the relation between $\gamma$ and $\delta$ can be actually expressed by $\gamma \cong \delta$.

Accordingly, after the applied voltage of the original lighting lamp required for getting the light portion potential VLtx from the dark portion potential VDtx is adjusted, the adjusted applied voltage is simply multiplied by $\gamma$ ($\cong \delta$) to obtain a value, and the obtained value is applied to the original lighting lamp so that VLph relative to VDph which is relatively similar to the target light portion potential can be generated on the photosensitive drum 2.

FIG. 8 explains differences between the above described conventional example and the first embodiment. As mentioned above, in the conventional example, since the applied voltage of the primary electrifier 4 and the applied voltage of the original lighting lamp 22 are respectively adjusted for 2 to 3 seconds, it takes about 10 seconds for a total potential control time.

On the other hand, according to the first embodiment of the invention, the adjustment for the photographic mode is achieved only by calculating the proportional constants obtained from the adjustment of the character mode, so that an adjustment process is not carried out and time is not substantially consumed.

Accordingly, in the first embodiment of the invention, a total time necessary for a potential control (image mode control) can be reduced by half as compared with the conventional example. During a preparation period, for instance, a warming-up period of the fixing device (waiting time) until an image forming process is started after the power supply is switched on, both the potentials for adjusting the character mode and the photographic mode may be detected. Further, during a pre-rotation period until the formation of an image is started after an image forming start signal is inputted to the image forming apparatus main body, the potential for adjusting the photographic mode may not be detected and the potential for adjusting the character mode may be carried out.

In the first embodiment, although two kinds of image modes are compared with each other, it is to be understood that three kinds of image modes or more may be effectively compared mutually and as the number of kinds of image modes is increased, an improvement ratio is more increased.

Further, in the first embodiment, although both the image modes employ the same light portion potential, it is to be understood that different light portion potentials may be effectively used without difficulty. Further, an example in which the potential is adjusted by using either the applied voltage of the primary electrifier 4 or the applied voltage of the original lighting lamp 22 may be included in the present invention.

Still further, in the first embodiment, although the applied voltage of the primary electrifier 4 or the applied voltage of the original lighting lamp 22 is changed so that the dark portion potential or the light portion potential is created, it is to be understood that the current value of the primary electrifier 4 or a grid voltage not shown may be changed without trouble to form the dark portion potential or the light portion potential, and if the amount of exposure of the original lighting lamp can be adjusted, the original lighting lamp 22 may be changed by means other than its applied voltage.

Still further, the data capable of adjusting the charge amount of the primary electrifier 4 or the amount of exposure of the original lighting lamp 22 in the control board shown in FIG. 2 can also be operated (or adjusted).

(Second Embodiment)

Figure 9:
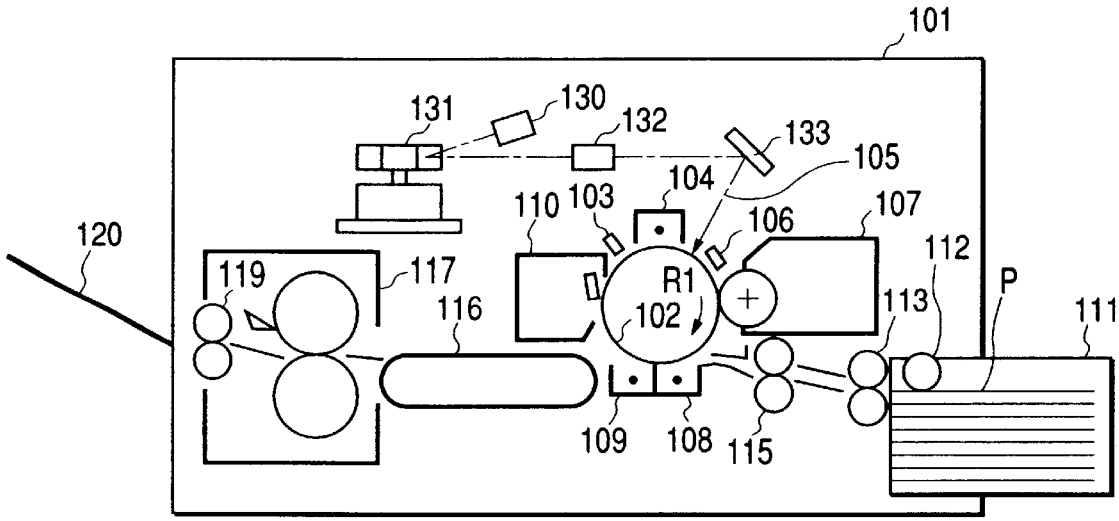
FIG. 9 is a diagram showing a printer as one example of an image forming apparatus according to a second embodiment.

Referring to FIGS. 9 to 12, 13A, 13B, 14, 15A and 15B, a second embodiment of the present invention will be described. FIG. 9 schematically shows a printer as one example of an image forming apparatus according to the second embodiment.

This printer is provided with a cylindrical photosensitive drum 102 which is an electrophotographic photosensitive member substantially at the center of an apparatus main body 101.

The photosensitive drum 102 is supported by the apparatus main body 101 so as to be rotatable in the direction shown by an arrow mark R1. On the periphery of the photosensitive drum 102, a deelectrifier 103 for removing a potential on the photosensitive drum 102, a primary electrifier 104 as charging or electrifying means for uniformly electrifying the surface of the photosensitive drum 102, exposure means 105 for exposing the surface of the photosensitive drum 102 to form an electrostatic latent image, a potential sensor 106 as potential detecting means for measuring the potential on the photosensitive drum 102 after an exposure process, a developing device 107 as developing means for allowing toner as a developer to stick to the electrostatic latent image to form a toner image, a transfer electrifier 108 for transferring the toner image to a transfer material P, a separating electrifier 109 for separating the transfer material P from the photosensitive drum 102 and a cleaner 110 for removing residual toner on the photosensitive drum 102 which are sequentially arranged along the rotating direction of the photosensitive drum 2.

The transfer material P to which the toner image is transferred is supplied from a sheet feed deck 111. The sheet feed deck 111 in which the transfer materials P are contained is disposed below the photosensitive drum 102, that is to say, in the lower part inside the apparatus main body 101.

The transfer materials P in the sheet feed deck 111 are supplied by a sheetfeed roller 112 and fed to a part between the photosensitive drum 102 and the transfer electrifier 108 through a conveying roller 113 and a registration roller 115. Here, the toner image is transferred to the transfer materials P from the photosensitive drum 102 and the transfer materials P to which the toner image is transferred are conveyed to a fixing device 117 by a conveyor belt 116.

The transfer materials P to which the toner image is fixed by heat and pressure applied by the fixing device 117 are discharged as copies to which the image is finally fixed to sheet discharge tray 120 by a sheet discharging roller 119.

In the above described printer, the exposure means 106 is designed to scan laser beams applied in accordance with an image signal from a semiconductor laser 130 by a polygon mirror 131 and guide the laser beams to the photosensitive drum 102 through an image forming lens 132 and a reflecting mirror 133.

Figure 10:
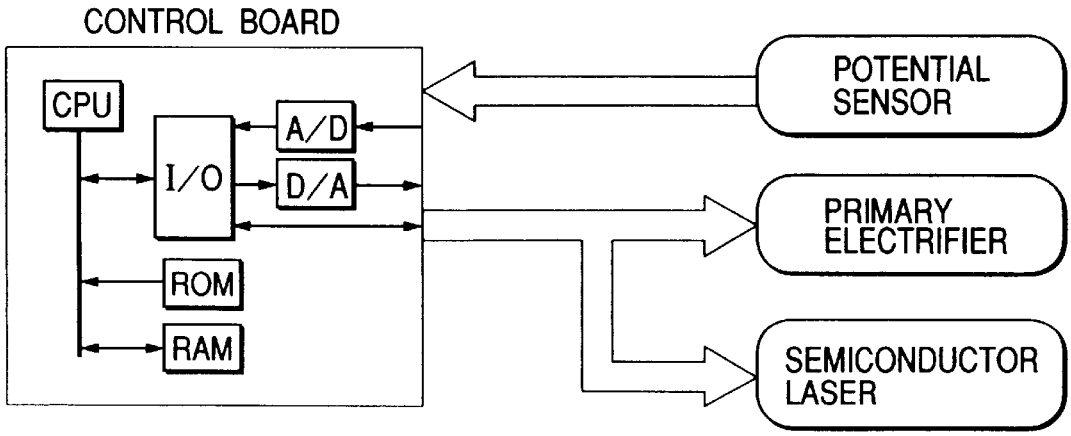
FIG. 10 is a diagram of an electric structure showing the periphery of a control panel for measuring the potential of a photosensitive drum according to a second embodiment.

FIG. 10 is a diagram for schematically explaining an electric structure in the periphery of a control board for measuring the potential on the photosensitive drum 102. Referring to FIG. 10, in the control board, a ROM in which a control program is described and a RAM as a temporary storage element for necessary data on a program are connected to a CPU as the central element of processes.

Further, an I/O as an interface element and an A/D converter and a D/A converter as the converting elements of data are connected to external peripheral devices to input information to and output information from the control board. As the peripheral device of the second embodiment, the potential sensor 106 can measure the potential on the photosensitive drum 102 after the photosensitive drum is electrified and exposed.

Then, from the detected result of the potential sensor 106, the applied voltage of the primary electrifier 104 and the applied voltage of the semiconductor laser can be controlled.

Figure 11:
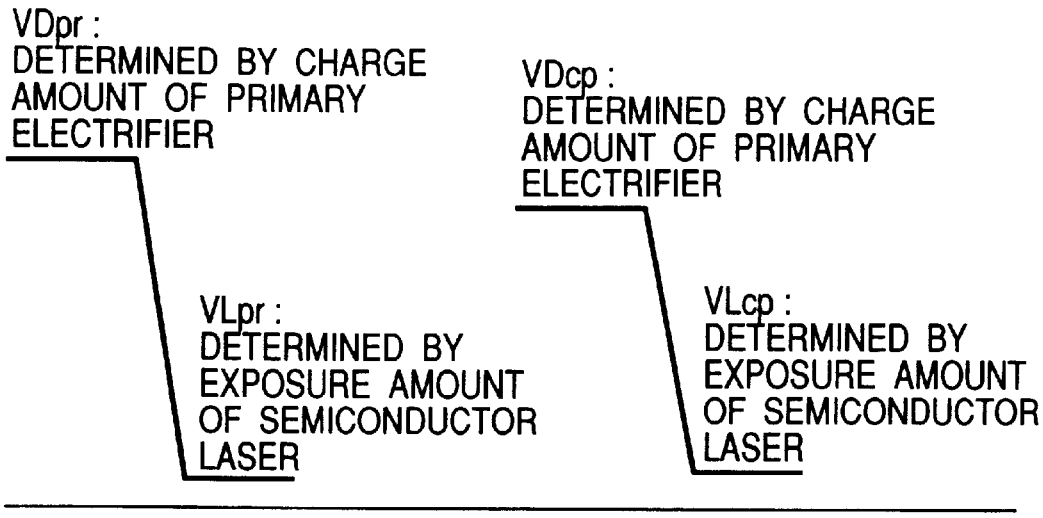
FIG. 11 is a schematic view showing two kinds of potentials (image mode) on the photosensitive drum.

FIG. 11 schematically shows a case in which there exist two kinds of setting potentials on the photosensitive drum 102. The two kinds of setting potentials show two types of image modes including a printer mode (with subscript pr) and a copy mode (with subscript cp). The printer mode and the copy mode can be selected in such a manner that an operator designates an operation panel or the like.

In this case, the dark portion potentials VDpr and VDcp show potentials on the photosensitive drum 102 when a laser is turned off, and the light portion potentials VLpr and VLcp show potentials on the photosensitive drum 102 when a laser is turned on.

The printer mode indicates a mode for forming an image by inputting an image signal from a computer or the like. In the printer mode, since an original is not used and electric information is used as an original image in place of the original, a relatively dark reproduction is generally performed in order to improve a visibility. Therefore, the dark portion potential VDpr is set to 480 V and the light portion potential VLpr is set to 40 V so that a relatively high latent image contrast is designated as a setting target.

The copy mode indicates a mode for copying the image of an original mounted on an original base or the like and requires such a high reproducibility as near the original as much as possible, because the original is present. Therefore, the dark portion potential VDcp is set to 400 V lower than that of the printer mode and the light portion potential VLcp is set to 50 V so that a relatively low latent image contrast is designated as a setting target.

Figure 12:
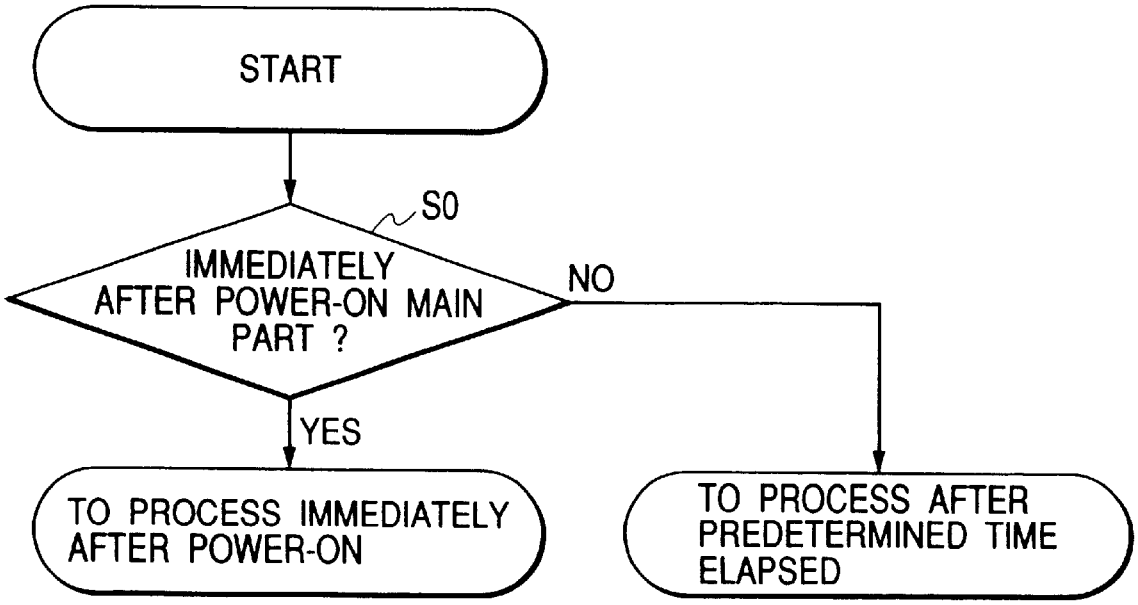
FIG. 12 is a flowchart showing a potential control sequence according to the second embodiment.
Figures 13, 13A, 13B:
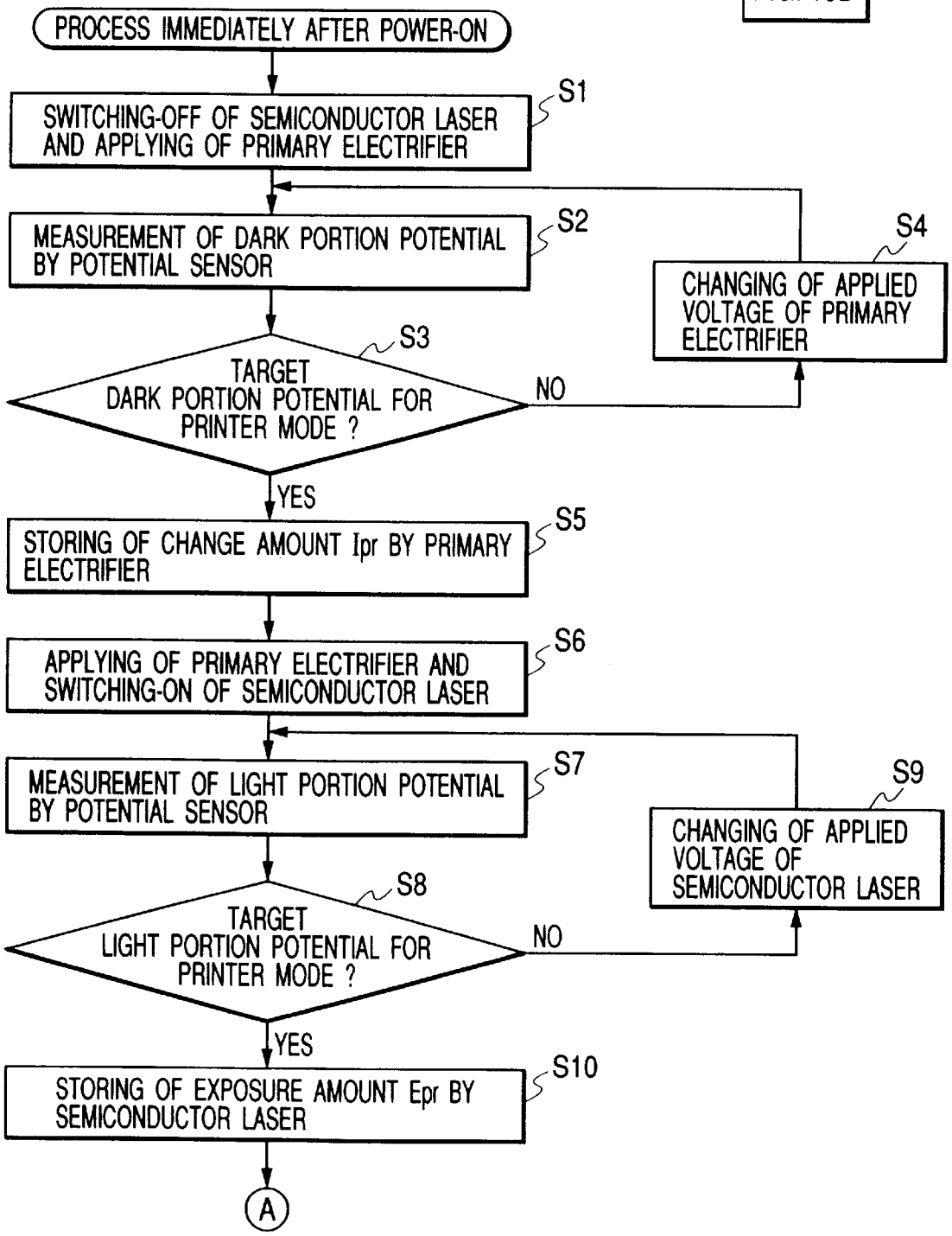
FIG. 13 which is composed of FIGS. 13A and 13B are flowchart showing a potential control sequence according to the second embodiment.
Figure 13B:
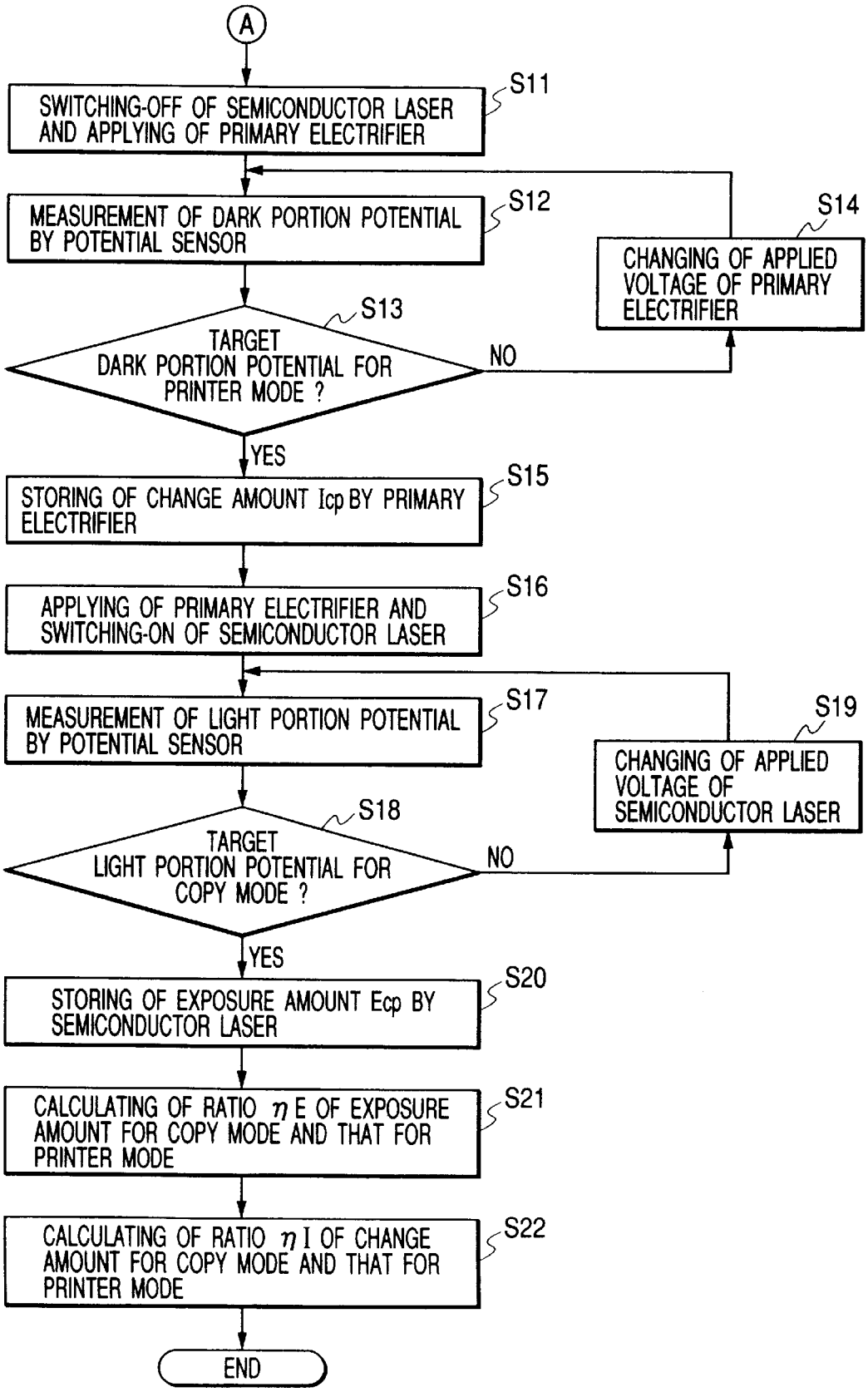
Figure 14:
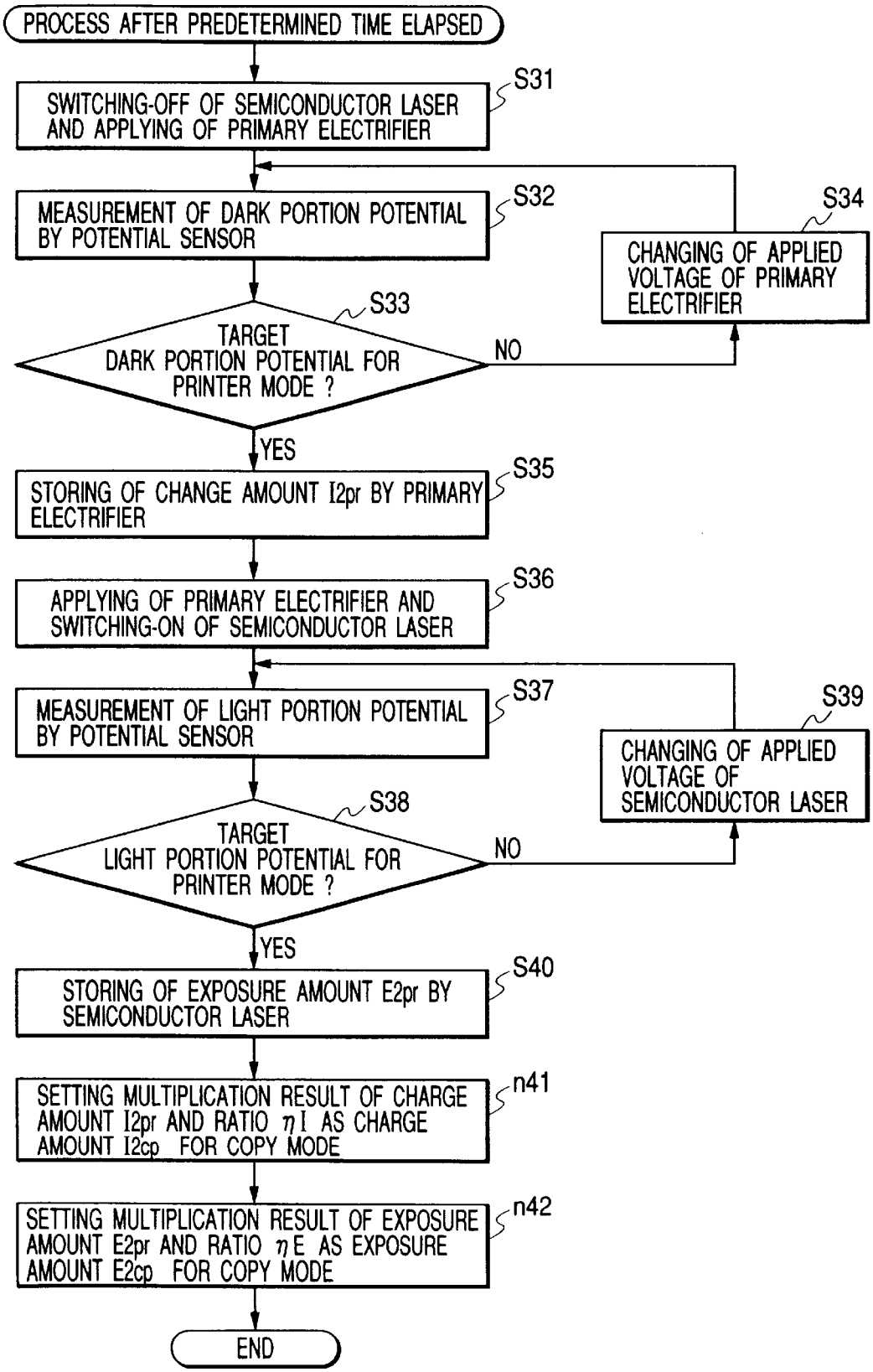
FIG. 14 is a flowchart showing a potential control sequence according to the second embodiment.

FIGS. 12, 13 and 14 show flowcharts at timings when a potential control (image mode control) sequence in the second embodiment is carried out.

Referring to FIG. 12, initially, it is decided whether or not the power supply of the image forming apparatus was just switched on (s0). At this time, when the power supply is just switched on, a potential control similar to the sequence of the conventional example shown in FIG. 4 is performed. While the image forming apparatus is switched on or started, it takes several ten seconds to several minutes to heat the fixing device 117 shown in FIG. 9. Even when the potential control is performed during this period as in the conventional case, any problem is not generated, because the temperature rise time of the fixing device 117 is equivalent to a time necessary for waiting for the rise of temperature. Thus, the potential control is carried out on the basis of the detections of both the potentials for the printer mode and the copy mode.

In the potential control immediately after the power supply is switched on, the semiconductor laser is turned off and a prescribed voltage is applied to the primary electrifier 104 to generate an initial dark portion potential VDpr (s1), as shown in FIGS. 13A and 13B.

The initial applied voltage may be a prescribed value or a voltage value upon control of a previous time. The dark portion potential VDpr is measured by the potential sensor 106 (s2) located in the downstream side of the primary electrifier 104 of the photosensitive drum 102 to recognize (s3) whether or not the dark portion potential reaches 480 V+3 V which is the target dark portion potential VDpr as shown in FIG. 11.

When the dark portion potential is not located within a range of 480 V±3 V, the applied voltage of the primary electrifier 104 is increased or decreased (s4) to urge again the dark portion potential VDpr on to reach to the target potential.

As a result, an amount of electric current in the applied voltage of the primary electrifier 104, in other words, an amount of electrification Ipr is stored in the RAM as the storage element (s5).

Then, while the photosensitive drum 102 is electrified by the applied voltage of the primary electrifier 104 driven in the above described sequence, the semiconductor laser is turned on to generate the light portion potential VLpr on the photosensitive drum 102 (s6).

At this time, the voltage applied to the semiconductor laser may be a prescribed value or a voltage value upon control of a previous time. This light portion potential VLpr is measured by the potential sensor 106 (s7) to recognize whether or not the light portion potential reaches 40 V+3 V which is the target light portion potential VLpr as shown in FIG. 11 (s8).

When the light portion potential is not located within a range of 40 V+3 V, the applied voltage of the semiconductor laser is increased or decreased (s9) to urge again the light portion potential VLpr on to reach to the target potential.

As a consequence, the amount of exposure Epr of the semiconductor laser is stored in the RAM as the storage element (s10).

Subsequently, the amount of electrification and the amount of exposure for the copy mode need to be adjusted. Initially, the semiconductor laser is turned off and a prescribed voltage is applied to the primary electrifier 104 to generate an initial dark portion potential VDcp (s11).

The initial applied voltage may be a prescribed value or a voltage value upon control of a previous time. The dark portion potential VDcp is measured by the potential sensor 106 (s12) located in the downstream side of the primary electrifier 104 of the photosensitive drum 102 to recognize (s13) whether or not the dark portion potential reaches 400 V±3 V which is the target dark portion potential VDcp as shown in FIG. 11.

When the dark portion potential is not located within a range of 480 V+3 V, the applied voltage of the primary electrifier 104 is increased or decreased (s14) to urge again the dark portion potential VDcp on to reach to the target potential.

As a result, an amount of electric current in the applied voltage of the primary electrifier 104, in other words, an amount of electrification Icp is stored in the RAM as the storage element (s15).

Then, while the photosensitive drum 102 is electrified by the applied voltage of the primary electrifier 104 driven in the above described sequence, the semiconductor laser is turned on to generate the light portion potential VLcp on the photosensitive drum 102 (s16).

At this time, the voltage applied to the semiconductor laser may be a prescribed value or a voltage value upon control of the last time. This light portion potential VLcp is measured by the potential sensor 106 (s17) to recognize whether or not the light portion potential reaches 50 V+3 V which is the target light portion potential VLcp as shown in FIG. 11 (s18).

When the light portion potential is not located within a range of 50 V±3 V, the applied voltage of the semiconductor laser is increased or decreased (s19)to urge again the light portion potential VLcp on to reach to the target potential.

As a consequence, the amount of exposure Ecp of the semiconductor laser is stored in the RAM as the storage element (s20).

As mentioned above, the potential control (image mode control) similar to the prior art is performed. In the second embodiment, the amount of electrification and the amount of exposure of the respective printer mode and the copy mode are previously stored in the RAM as the storage element.

Thus, in the second embodiment, the ratio ηI of the amount of electrification in the respective image modes is obtained and the ratio is stored in the RAM serving as the storage element (s21). The ratio ηE of the amount of exposure in the respective image modes is obtained and the ratio is equally stored in the RAM as the storage element (s22).

At this time, the ratio ηI of the amount of electrification and the ratio ηE of the amount of exposure in the respective image modes are defined by the following equations.

$$\eta I = Icp/Ipr$$

$$\eta E = Ecp/Epr$$

Here, Icp designates the amount of electrification for the copy mode, Ipr designates the amount of electrification for the printer mode, Ecp designates the amount of exposure for the copy mode and Epr designates the amount of exposure for the printer mode.

Now, by referring to a flowchart at a timing when the potential control (image mode control) is subsequently performed as shown in FIG. 14, a potential control process (image mode control means) carried out upon first output of an image with the lapse of 10 minutes or 60 minutes after the power supply of the image forming apparatus main body is switched on will be described below.

In the potential control process shown in FIG. 14, the potential control for the printer mode is initially performed. Initially, the semiconductor laser is turned off and a prescribed voltage is applied to the primary electrifier 104 to generate an initial dark portion potential VDpr (s31).

The initial applied voltage may be a prescribed value or a voltage value upon control of a previous time. The dark portion potential VDpr is measured by the potential sensor 106 (s32) located in the downstream side of the primary electrifier 104 of the photosensitive drum 102 to recognize (s33) whether or not the dark portion potential reaches 480 V±3 V which is the target dark portion potential VDpr as shown in FIG. 11.

When the dark portion potential is not located within a range of 480 V±3 V, the applied voltage of the primary electrifier 104 is increased or decreased (s34) to urge again the dark portion potential VDpr on to reach to the target potential.

As a result, an amount of electric current in the applied voltage of the primary electrifier 104, in other words, an amount of electrification I2pr is stored in the RAM as the storage element (s35).

The amount of electrification I2pr changes in terms of time to become frequently a value different from the amount of electrification Ipr when the power supply is switched on. Therefore, a potential control is required after a prescribed time elapses.

Then, while the photosensitive drum 102 is electrified by the applied voltage of the primary electrifier 104 driven in the above described sequence, the semiconductor laser is turned on to generate the light portion potential VLpr on the photosensitive drum 102 (s36).

At this time, the voltage applied to the semiconductor laser may be a prescribed value or a voltage value upon control of a previous time. This light portion potential VLpr is measured by the potential sensor 106 (s37) to recognize whether or not the light portion potential reaches 40 V±3 V which is the target light portion potential VLpr as shown in FIG. 11 (s38).

When the light portion potential is not located within a range of 40 V±3 V, the applied voltage of the semiconductor laser is increased or decreased (s39)to urge again the light portion potential VLpr on to reach to the target potential.

As a consequence, the amount of exposure E2pr of the semiconductor laser is stored in the RAM as the storage element (s40).

The amount of exposure E2pr may often change in time from that at power-on time. Therefore, a potential control is required after a prescribed time elapses.

As described above, in the potential control process (image mode control) after a prescribed time elapses, after the potential control for the printer mode is first performed, the potential for the copy mode is determined. At this time, the amount of electrification and the amount of exposure for the copy mode are not actually detected by the potential sensor 106 nor adjusted, but are obtained by a calculation.

Specifically, the amount of electrification I2cp and the amount of exposure E2cp for the copy mode are determined in accordance with the following equations.

$$I2cp=I2pr\cdot\eta I=I2pr\cdot(Icp/Ipr)$$

$$E2cp=E2pr\cdot\eta E=E2pr\cdot(Ecp/Epr)$$

As apparent from the above equations, the amount of electrification I2cp for the copy mode after a prescribed time elapses is determined by obtaining a product of the amount of electrification I2pr for the printer mode which is previously determined and the ratio ηI of the amount of electrification for the copy mode and the amount of electrification for the printer mode when the power is switched on (s41).

Further, the amount of exposure E2cp for the copy mode after a prescribed time elapses is obtained by getting a product of the previously determined amount of exposure E2pr for the printer mode and the ratio ηE of the amount of exposure for the copy mode and the amount of exposure for the printer mode upon switching on the power source (s42).

In this manner, the potential control which is strong relative to the fluctuation of the main body can be carried out with high accuracy in place of ratios α, γ shown in the first embodiment.

As described above, in a pre-rotation period until the formation of the image is started after an image forming start signal is externally inputted to the apparatus main body, the potential control for the printer mode and for the copy mode may be carried out on the basis of the detected result of the potential for the printer mode.

FIG. 15B explain the differences between the conventional example described in the first embodiment which is changed to two kinds of image modes for the printer mode and the copy mode by using digital type exposure means (in the explanation, two kinds of a character mode and a photographic mode in an analog type), the first embodiment which is similarly changed to two kinds of image modes including the printer mode and the copy mode by using the digital type exposure means (in the explanation, two kinds of image modes including the character mode and the photographic mode in an analog type) and the second embodiment.

In the repeated three methods respectively, means having two kinds of potential targets for the print mode and the copy mode by the digital type exposure means are compared mutually.

FIG. 15A shows a comparison of the potential controls when the power supply is switched on between the three methods. FIG. 15B shows a comparison of the potential controls upon output of an image with the lapse of 10 minutes and 60 minutes after the power supply is switched on.

In FIG. 15A, according to the conventional example and the second embodiment, since the amounts of electrification of the primary electrifier and the amounts of exposure of the semiconductor laser of the two kinds of image modes are respectively adjusted for 2 to 3 seconds, it takes about 10 seconds to perform total potential control processes. However, since a time for switching on or activating the fixing device upon switching on the power supply is needed as described above, even if a total time is slightly increased, this will not cause any trouble.

On the other hand, as shown in FIG. 15B, a total time for a potential control necessary for the potential control processes after a prescribed time elapses is desirably shortened as much as possible. The conventional example is completely disadvantageous in view of the total time for potential control so that a productivity is decreased.

The first embodiment shown in FIG. 15B is advantageous in view of a total time for potential control to suppress the deterioration of a productivity. However, since the potential for the copy mode is calculated on the basis of a prescribed ratio, the accuracy of an absolute photosensitive potential after the potential control process is slightly lower than that of the conventional example. Further, since the prescribed ratio is employed, an effective value of variation among the image forming apparatus main bodies is large, and a combined variation is relatively increased.

On the other hand, according to the second embodiment, since the ratios of the amount of electrification and the amount of exposure for the copy mode and for the printer mode are respectively obtained at the time of switching on the power supply when there exists a sufficient time, and the amount of electrification and the amount of exposure for the copy mode are calculated with the lapse of time when there is insufficient time by employing the above ratios, the variation is not generated between the image forming apparatus, the primary electrifier and the semiconductor laser, as compared with the first embodiment.

Consequently, a combined variation is improved compared with that of the first embodiment.

In the case where the power supply of the image forming apparatus main body is switched on again immediately after it is switched off due to any reason, for instance, when the temperature of the fixing device shown in FIG. 9 is not ordinary temperature and relatively high, it does not take much time to switch on or activate the fixing device 117 irrespective of a fact that the power supply is just switched on. Therefore, a plurality of kinds of potential control are not completely performed as in the sequence of the conventional example and the sequence using the ratios of the second embodiment which is employed before the power supply is previously turned off is utilized, so that the maneuverability of a user can be improved.

(Third Embodiment)

Now, referring to FIGS. 16 and 17, a third embodiment of the present invention will be described. In the first and second embodiments, the potential control when there exist a plurality of kinds of the dark portion potentials and the light portion potentials on the photosensitive drum was described. In the third embodiment, will be described a control method for a developing potential in a developing device after the photosensitive drum is subjected to an electrification process and an exposure process will be described.

Figure 16:
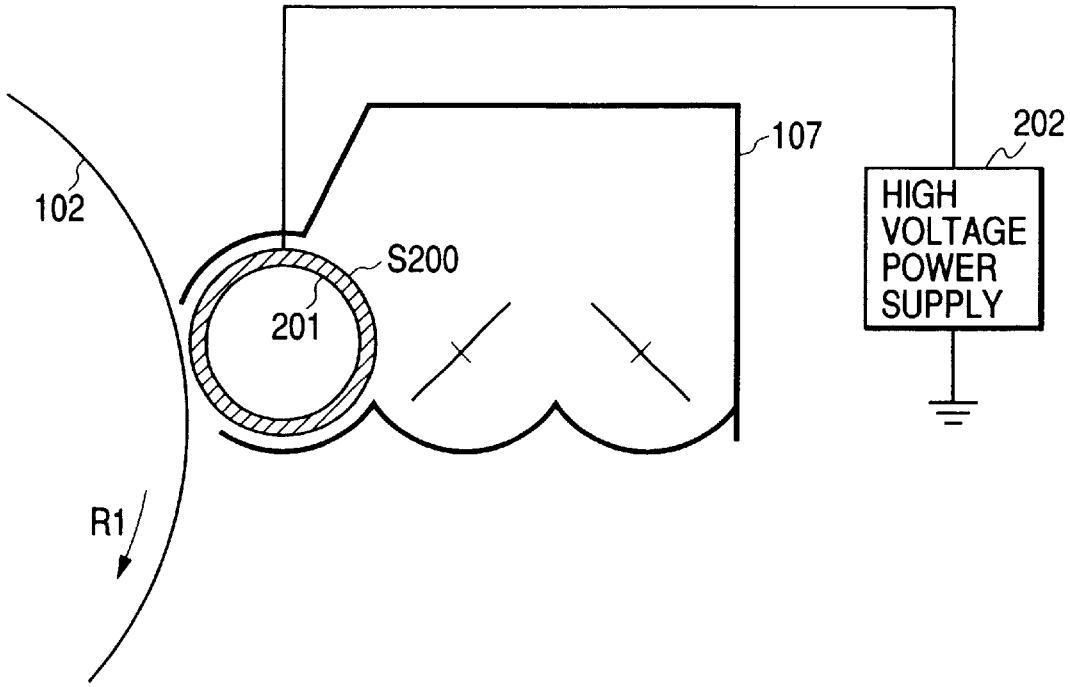
FIG. 16 is an explanatory view showing a developing device according to a third embodiment.

The developing device 107 has a toner layer (S200) coated with a thin layer as shown in FIG. 16 so that toner is stuck to a photosensitive drum 102 after subjected to the electrification and exposure processes by a developing sleeve 201 rotating to come near to the photosensitive drum 102.

At this time, in order to allow the toner to stick to the photosensitive drum 102, a high voltage power supply 202 is connected to the developing sleeve 201 of the developing device 107. Generally, the high voltage power supply 202 has a potential obtained by superposing an alternating current component on a direct current component.

Vpp of the alternating current component of the high voltage power supply 202 may be operated, the frequency of the alternating current component may be operated or the potential of the direct current component may be operated. In the third embodiment, an image forming apparatus in which the potential of the direct current component is adjusted will be described. In this case, an object to be operated in the high voltage power supply 202 may be Vpp or the frequency without difficulty.

The third embodiment will be described for controlling the developing device 107 subsequently to the second embodiment. Therefore, it is assumed that the amount of electrification and the amount of exposure for the printer mode and the amount of electrification and the amount of exposure for the copy mode are determined in the second embodiment.

Figure 17:
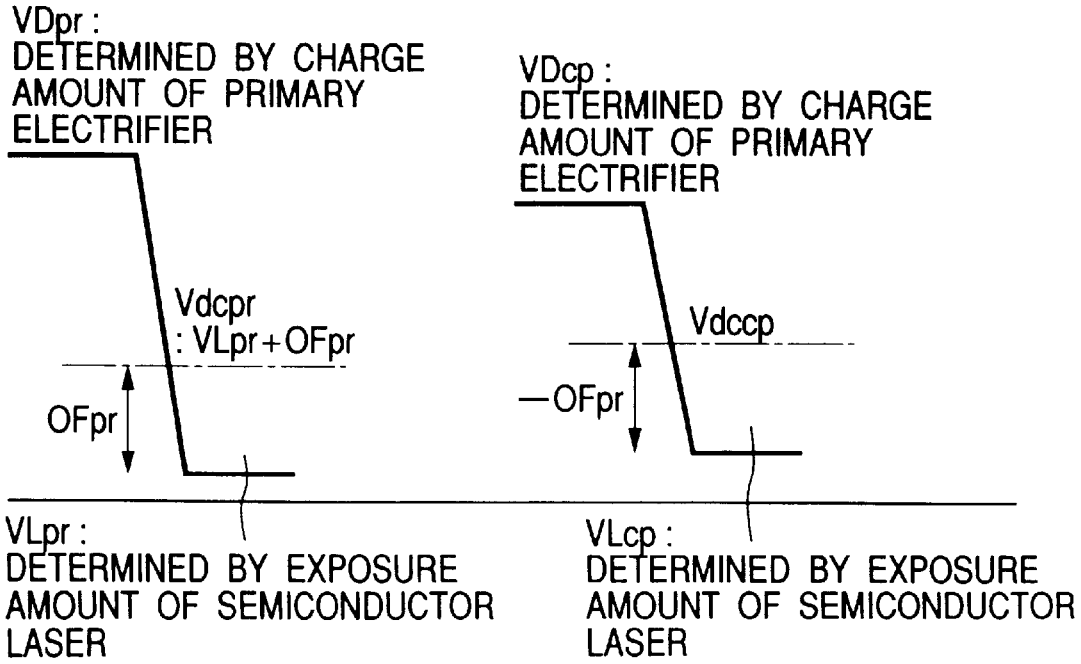
FIG. 17 is a schematic view showing two kinds of potentials on a photosensitive drum and two kinds of developing potentials.

FIG. 17 shows developing potentials as the control targets of the developing device 107, that is to say, the values of the direct current components of the high voltage power supply 202 for the developing device 107 as well as the potentials to be determined on the photosensitive drum 102 as shown in the second embodiment.

Since the printer mode has no original and uses electronic information as an original image in place of the original, a relatively dark reproduction is carried out in order to improve a visibility. Therefore, a developing potential Vdcpr is set to 150 V as a target potential.

Since the copy mode has an original, a reproducibility similar to the original as much as possible is requested. Therefore, a developing potential Vdccp is set to 180 V as a target potential higher than the developing potential of the printer mode.

The image forming apparatus is roughly classified into an apparatus for allowing toner to stick to the dark portion potential and an apparatus for allowing toner to stick to the light portion potential. At this time, a white ground or white base may be formed in different portions such as the light portion potential or the dark portion potential. In the explanation of the third embodiment, the light portion potential is designated as a potential on a white ground (namely, a white ground potential), however, the dark portion potential may be designated as the white ground potential without inconvenience in view of the characteristics of the present invention.

On the other hand, if the developing potentials Vdcpr and Vdccp are fixed and respectively determined to be 150 V and 180 V, a difference between the white ground potential (here, the light portion potential) and the developing potential becomes uneven so that an image fog is undesirably generated.

Thus, after the light portion potential is determined, an offset part is added to the white ground potential to always make a difference, what is called a fog removing potential, from the white ground potential constant so that the image fog can be prevented.

As for the offset part, there are provided expressions of OFpr=110 V for the printer mode and OFcp=130 V for the copy mode.

Accordingly, in the third embodiment of the present invention, upon control of a potential after the power supply of the image forming apparatus is switched on, after the light portion potential VLpr for the printer mode and the light portion potential VLcp for the copy mode are adjusted, respective developing potentials Vdcpr and Vdccp are obtained by calculating the following equations.

$$Vdcpr=VLpr+OFpr$$

$$Vdccp=VLcp+OFcp$$

At this time, a difference ΔVdc between the developing potential Vdccp for the copy mode and the developing potential Vdcpr for the printer mode is obtained by the following equation.

$$\Delta Vdc=Vdccp-Vdcpr$$

The obtained difference is stored in a RAM as a storage element.

Then, upon control of a potential after a prescribed time elapses, the amount of electrification I2cp and the amount of exposure E2cp for the copy mode are obtained from the amount of electrification I2pr and the amount of exposure E2pr for the printer mode in accordance with the second embodiment. Further, in the third embodiment, the developing potentials Vdc2pr and Vdc2cp are calculated from the following equations.

$$Vdc2pr=VL2pr+OFpr$$

$$Vdc2cp=Vdc2pr+\Delta Vdc$$

In the above described equations, since the light portion potential VL2pr is actually measured, the developing potential Vdc2pr for the printer mode is obtained by adding an offset part to the light portion potential VL2pr like upon switching on the power supply. On the other hand, as for the developing potential Vdc2cp for the copy mode, the actual light portion potential VL2cp cannot be known during the potential control process.

It is to be understood that the light portion potential can be measured if time is taken, however, the productivity is deteriorated when the measurement is carried out, so that the light portion potential is not measured.

Thus, the sum of the adjusted developing potential Vdc2pr for the printer mode and the difference ΔVdc between the developing potential Vdccp for the copy mode obtained upon previously switching on the power supply and the developing potential Vdcpr for the printer mode may be calculated to obtain the developing potential Vdc2cp for the copy mode.

In such a way, a total potential control including the developing potential can be performed and a highly accurate and constantly stable image forming apparatus can be provided without lowering the productivity related to elements for controlling the quality of an actual output image.

In the third embodiment, although the image forming apparatus in which the potential of the direct current component can be adjusted is described employing a difference Vdc, Vpp or the frequency of the alternating current component may be employed without difficulty. In this case, a calculation using the ratio without the difference may give a high estimation accuracy, so that the calculation is not limited to a calculation using the difference.

As mentioned above, according to the present invention, it takes much time to actually adjust one image mode, however, it does not take much time to adjust the remaining image mode, so that the image modes can be adjusted without deteriorating the productivity.

What is claimed is:

1. An image forming apparatus comprising:

an image bearing member;

image forming means for forming an image on said image bearing member;

detecting means for detecting a surface potential of the image bearing member; and control means for controlling image forming conditions, wherein a first image forming mode and a second image forming mode in which image forming conditions of said image forming means are different from each other can be selected, and wherein said control means controls the image forming conditions in the first and second image forming modes on the basis of a result detected by said detecting means for the first image forming mode.

2. An image forming apparatus according to claim 1, wherein said image forming means includes electrostatic image forming means for forming an electrostatic image on said image bearing member and developing means for developing the electrostatic image by a developer.

3. An image forming apparatus according to claim 2, wherein the image forming conditions include at least one of an electrostatic image forming condition of the electrostatic image forming means and a developing condition of the developing means.

4. An image forming apparatus according to claim 3, wherein said image bearing member is a photosensitive member, the electrostatic image forming means is provided with electrifying means for electrifying said image bearing member and exposure means for exposing said image bearing member, and the electrostatic image forming condition includes at least one of a charging condition of the electrifying means and an exposure condition of the exposure means.

5. An image forming apparatus according to claim 4, wherein the charging condition includes an amount of electrification for electrifying said image bearing member by the electrifying means.

6. An image forming apparatus according to claim 4, wherein the exposure condition is an amount of exposure for exposing said image bearing member by the exposure means.

7. An image forming apparatus according to claim 3, wherein the developing condition includes a developing bias potential applied to the developing means.

8. An image forming apparatus according to claim 1, wherein the image forming condition in the second image forming mode is obtained by calculation from the image forming condition in the first image forming mode.

9. An image forming apparatus according to claim 1, wherein the detecting operation of said detecting means is carried out for the first and second image forming modes during a preparation period for forming an image of said image forming apparatus after said image forming apparatus is powered on.

10. An image forming apparatus according to claim 1, wherein the detecting operation of said detecting means for the first image forming mode is carried out without performing the detecting operation of said detecting means for the second image forming mode until the formation of an image is started after an image forming start signal is inputted to said image forming apparatus.

11. An image forming apparatus according to claim 1, wherein the first image forming mode is a character image forming mode and the second image forming mode is a photographic image forming mode.

12. An image forming apparatus according to claim 1, wherein the first image forming mode is a printer mode and the second image forming mode is a copy mode.

13. An image forming apparatus according to claim 12, wherein said image forming means is provided with electrostatic image forming means for forming an electrostatic image on said image bearing member and developing means for developing the electrostatic image with a developer, said image bearing member is a photosensitive member, and the electrostatic image forming means is provided with electrifying means for electrifying said image bearing member and exposure means for exposing said image bearing member in accordance with an image signal.

14. An image forming apparatus comprising:

an image bearing member;

electrifying means for electrifying a surface of said image bearing member in order to form an image on the surface of said image bearing member;

detecting means for detecting a surface potential of said image bearing member; and setting means for setting voltages to be applied to said electrifying means, wherein a first image forming mode and a second image forming mode for forming an image on the surface of said image bearing member in image forming conditions that differ from each other at least in a target surface potential of said image bearing member by said electrifying means can be selected, and wherein said setting means sets the voltages to be applied to said electrifying means in the first image forming mode and the second image forming mode on the basis of a result detected by said detecting means in either the first image forming mode or the second image forming mode.

15. An image forming apparatus according to claim 14, wherein when a detecting operation by said detecting means is performed in the first image forming mode, said setting means sets the voltage for the second image forming mode in accordance with the voltage set for the first image forming mode based on a result detected in the detecting operation.

16. An image forming apparatus according to claim 15, wherein the detecting operation by said detecting means for the first image forming mode is performed and a setting operation by said setting means for the first image forming mode and the second image forming mode is performed without performing the detecting operation by said detecting means for the second image forming mode until the formation of the image is started after an image forming start signal is inputted to said image forming apparatus.

17. An image forming apparatus according to claim 16, wherein the detecting operation by said detecting means and the setting operation by said setting means for the first image forming mode and the second image forming mode are performed during a preparation period of said image forming apparatus for forming an image after said image forming apparatus is powered on.

18. An image forming apparatus according to claim 14, wherein said image bearing member is a photosensitive member, and said image forming apparatus further comprises:

exposure means for exposing the electrified surface of said image bearing member to form an electrostatic latent image thereon; and developing means for developing the electrostatic latent image formed on the surface of said image bearing member.

19. An image forming apparatus according to claim 18, wherein the image forming conditions include at least one of an exposure condition of said exposure means and a developing condition of said developing means.

20. An image forming apparatus according to claim 19, wherein the exposure condition is an amount of exposure for exposing said image bearing member by said exposure means.

21. An image forming apparatus according to claim 19, wherein the developing condition is a developing bias applied to said developing means.

22. An image forming apparatus according to any one of claims 14 to 21, wherein the first image forming mode is one of a printer mode and a copy mode, and the second image forming mode is the other one.

23. An image forming apparatus according to claim 14, wherein the first image forming mode is one of a character image forming mode and a photographic image forming mode, and the second image forming mode is the other one.

* * * * *

UNITED STATES PATENT AND TRADEMARK OFFICE

CERTIFICATE OF CORRECTION

PATENT NO. : 6,493,524 B2
DATED : December 10, 2002
INVENTOR(S) : Yuji Kamiya

It is certified that error appears in the above-identified patent and that said Letters Patent is hereby corrected as shown below:

Column 1,
Line 27, “image” should read -- image, which --.

Column 2,
Line 48, “are” should read -- is a --.

Column 5,
Line 11, “450 V+3 V,” should read -- 450 V±3 V, --;
Line 23, “durum” should read -- drum --; and
Line 37, “50 V+3 V,” should read -- 50 V±3 V --.

Column 6,
Line 9, “50 V+3 V,” should read -- 50 V±3 V, --.

Column 7,
Line 37, “a to” should read -- α to --.

Column 11,
Line 35, “V+3 V” should read -- V±3 V --;
Lines 55 and 59, “40 V+3 V,” should read -- 40 V±3 V, --.

Column 12,
Line 13, “480 V+3 V,” should read -- 480 V±3 V, --; and
Line 31, “50 V+3 V” should read -- 50 V±3 V --.

Column 15,
Line 42, “after” should read -- after being --.

Signed and Sealed this

Seventh Day of October, 2003

JAMES E. ROGAN
*Director of the United States Patent and Trademark Office*